US010984731B2

(12) United States Patent
Choi et al.

(10) Patent No.: US 10,984,731 B2
(45) Date of Patent: Apr. 20, 2021

(54) SYNCHRONOUSLY AND LOCALLY TURNING-OFF SUB PIXELS IN UNDER-DISPLAY SENSOR AREA OF AMOLED PANEL

(71) Applicant: Google LLC, Mountain View, CA (US)

(72) Inventors: Sangmoo Choi, Palo Alto, CA (US); Sun-il Chang, San Jose, CA (US); Sang Young Youn, Cupertino, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/559,491

(22) Filed: Sep. 3, 2019

(65) Prior Publication Data

US 2021/0065635 A1 Mar. 4, 2021

(51) Int. Cl.

| | |
|---|---|
| ***G09G 3/32*** | (2016.01) |
| ***G09G 3/3291*** | (2016.01) |
| ***G09G 3/20*** | (2006.01) |

(52) U.S. Cl.

CPC ..... *G09G 3/3291* (2013.01); *G09G 3/2003* (2013.01); *G09G 2320/0233* (2013.01); *G09G 2360/147* (2013.01)

(58) Field of Classification Search

CPC .. G09G 3/3266; G09G 3/3233; G09G 3/3258; G09G 3/0416; G09G 3/0412; G09G 3/2003; G09G 2300/0861; G09G 2300/0809; G09G 2300/0866; G09G 2310/0286; G09G 2310/0251; G09G 2310/0291; G09G 2320/0233; G09G 2360/147; H01L 27/323; H01L 27/3248

See application file for complete search history.

(56) References Cited

U.S. PATENT DOCUMENTS

| | | | |
|---|---|---|---|
| 9,997,111 | B2 | 6/2018 | Yang et al. |
| 2016/0055792 | A1 | 2/2016 | Lee et al. |

(Continued)

FOREIGN PATENT DOCUMENTS

| | | |
|---|---|---|
| WO | WO 2018187092 | 10/2018 |

OTHER PUBLICATIONS

Authorized officer Judit Wagner, Invitation to Pay Additional Fees and, where Applicable, Protest Fee in PCT/US2020/049253, dated Oct. 21, 2020, 30 pages.

(Continued)

*Primary Examiner* — Christopher E Leiby

(74) *Attorney, Agent, or Firm* — Fish & Richardson P.C.

(57) ABSTRACT

An apparatus is described that includes a display panel and a sensor. The display panel includes an array of pixels configured to direct light through a front side of the display panel. Each pixel includes sub-pixels, each of which includes an organic light emitting diode (OLED) and an integrated circuit (IC) for controlling an electrical current to the OLED. The sensor is arranged at a back side of the display panel. The sensor includes an emitter configured to emit electromagnetic radiation transmitted through a first area of the display panel. The IC of sub-pixels of the array of pixels outside the first area includes a first IC arrangement. The IC of sub-pixels of the array of pixels within the first area includes a transistor in addition to the first IC arrangement. The transistor is configured to operate as a control switch controlling emission of light from the sub-pixel.

15 Claims, 10 Drawing Sheets

(56) References Cited

U.S. PATENT DOCUMENTS

| | | | | |
|---|---|---|---|---|
| 2017/0171448 | A1 | 6/2017 | Evans et al. | |
| 2018/0164950 | A1* | 6/2018 | Kang | G06F 3/0421 |
| 2018/0211088 | A1* | 7/2018 | Cho | G09G 5/00 |
| 2019/0073954 | A1* | 3/2019 | Kuang | H01L 27/3265 |

OTHER PUBLICATIONS

PCT International Search Report and Written Opinion in International Appln. No. PCT/US2020/049253, dated Dec. 14, 2020, 32 pages.

* cited by examiner

SYNCHRONOUSLY AND LOCALLY TURNING-OFF SUB PIXELS IN UNDER-DISPLAY SENSOR AREA OF AMOLED PANEL

TECHNICAL FIELD

This disclosure relates organic light emitting diode (OLED) displays having under-display sensors, and more particularly, to synchronously and locally turning-off light emission from sub-pixels in under-display sensor area of an active matrix organic light emitting diode (AMOLED) panel to avoid undesirable image variations caused by electromagnetic radiation (e.g., IR light) emitted from sensor emitters under the AMOLED panel.

BACKGROUND

Display panels of mobile devices can include a sensor embedded underneath the cover glass of the screen, such as a front facing camera or facial recognition sensor. When such sensor performs the sensing of an associated parameter—such as 3D detection, proximity, or the like—an emitter of the sensor emits electromagnetic radiation such as infrared waves through the display. Interaction between the electromagnetic radiation from the sensor and a pixel circuit for driving an AMOLED display pixel can cause undesirable effects in the display, such as an unintentional luminance increase of the pixels due to an interaction between the EM radiation and the pixel circuits. For example, conventional circuits of sub-pixels of the pixels arranged in such display panel can cause an unintentional luminance increase due to an increase of the off-leakage current of transistor switches in the pixel circuit due to absorption of the electromagnetic radiation in the transistor structure. Such a luminance increase can undesirably cause image distortion due to the increased luminance. The sensor's performance can also be affected by the illumination of the display sub-pixels when they capture signals (such as visible light, and infrared) through the display panel since a small portion of light from a sub-pixel can be reflected backward by the display panel internal structures, and becomes a noise to the sensors.

SUMMARY

This disclosure relates to synchronously and locally turning-off sub-pixels in under-display sensor area of an organic light emitting diode (OLED) panel in coordination with the operation of the sensor. Such synchronous and local turning-off of the sub-pixels can reduce (e.g., avoid) undesirable brightness change resulting from electromagnetic radiation emitted by sensor emitters of the OLED panel.

In one aspect, an apparatus is described that includes a display panel and a sensor. The display panel includes an array of pixels configured to direct light through a front side of the display panel. Each pixel includes one or more sub-pixels. Each sub-pixel includes an organic light emitting diode (OLED) and an integrated circuit for controlling an electrical current to the OLED. The sensor is arranged at a back side of the display panel. The back side is opposite the front side. The sensor includes an emitter configured to emit electromagnetic (EM) radiation transmitted through a first area of the display panel. The integrated circuit of one or more sub-pixels of the array of pixels outside the first area of the display panel includes a first integrated circuit arrangement. The integrated circuit of one or more sub-pixels of the array of pixels within the first area of the display panel includes a transistor in addition to the first integrated circuit arrangement. The transistor is configured to operate as a control switch controlling emission of light from the sub-pixel.

In some variations, one or more of the following can additionally be implemented either individually or in any feasibly combination. The transistor is connected between a power source that supplies current to the sub-pixel circuit of the one or more sub-pixels of the array of pixels within the first area and the OLED of the corresponding sub-pixel. A gate of the control switch is connected to a control device configured to synchronize emission of light from a sub-pixel with emission of EM radiation from the sensor to reduce undesirable light emission from the sub-pixel due to absorption of EM radiation by the integrated circuit of the sub-pixel. The synchronized emission prevents abnormal brightening of at least one sub-pixel of the array of pixels within the particular area. The control device is configured to synchronize emission of light from multiple sub-pixels in the first area of the display panel with emission of EM radiation from the sensor to reduce undesirable light emission from the sub-pixel due to absorption of EM radiation by the integrated circuits of the multiple sub-pixels.

The first integrated circuit arrangement is a seven transistor, one capacitor arrangement.

In another aspect, a mobile device is described that includes the apparatus referred above.

In yet another aspect, an apparatus is described that includes at least one sensor and a display panel. The at least one sensor includes an emitter configured to emit electromagnetic radiation. The display panel includes an array of pixels located in a first area away from at least one sensor and a second area above the at least one sensor. Each pixel of the array of pixels includes two or more sub-pixels. One or more sub-pixels of the array of pixels within the first area includes a first sub-pixel circuit electrically initialized by a first initialization voltage during operation. One or more sub-pixels of the array of pixels in the second area includes a second sub-pixel circuit coupled to a control switch used to select a second initialization voltage during operation. The second initialization voltage is selected from options including the first initialization voltage and another voltage that is higher than the first initialization voltage. The control switch is controlled to select the second initialization voltage as the other voltage when the emitter emits the electromagnetic radiation.

In some variations, one or more of the following can additionally be implemented either individually or in any feasibly combination. The control switch is controlled by signals generated from one of a display driver IC, a timing controller IC, or a sensor system. The second area includes a plurality of sub-pixel circuits including the second sub-pixel circuit. During operation, an initialization voltage of each sub-pixel circuit of the plurality of sub-pixel circuits is synchronized with other sub-pixel circuits of the plurality of sub-pixel circuits. The selection of the second initialization voltage is configured to render a transistor of the second sub-pixel circuit in an off state. The off state of the transistor prevents the second sub-pixel from emitting light.

In some aspects, a method is described that modifies a sub-pixel circuit of an active matrix organic light emitting diode (AMOLED) display. A sub-pixel circuit is obtained. The sub-pixel circuit includes seven transistors and one capacitor. The sub-pixel circuit includes an input electrical node configured to be initialized with a first initialization voltage. The sub-pixel circuit is coupled to an organic light emitting diode (OLED) of a plurality of OLEDs of the AMOLED display. The sub-pixel circuit is configured to control a drive current to be passed through the OLED to control light emission from the OLED. An additional transistor is wired into the sub-pixel circuit. The additional transistor is configured to operate as a switch controlling a drive current in addition to already existing emission control switches in the sub-pixel circuit. A control switch is electrically connected to the input electrical node. The control switch provides the sub-pixel circuit with a selection between the first initialization voltage and a second initialization voltage to initialize the sub-pixel circuit. The second initialization voltage is higher than the first initialization voltage. The control switch is electrically connected to a control integrated circuit that causes the control switch to select the second initialization voltage when a sensor associated with the AMOLED display emits electromagnetic waves.

In some variations, one or more of the following can additionally be implemented either individually or in any feasibly combination. The control integrated circuit is at least one of a display driver IC, a timing controller block, and a sensor system. The selection of the second initialization voltage results renders a transistor of the sub-pixel circuit in an off-state that prevents light emission from the OLED. The above-referred method further includes assembling a mobile device that includes the AMOLED display and a sensor arranged behind the display and arranged to emit electromagnetic radiation through the display.

Some implementations can have the following advantages. The synchronous and local turning-off of the sub-pixels in an under-display sensor area of an OLED panel can advantageously avoid undesirable brightness increase associated with electromagnetic radiation emitted by a sensor emitter underneath the OLED panel, thereby providing a pleasing visual experience to a user.

The details of one or more implementations are set forth below. Other features and advantages of the subject matter will be apparent from the detailed description, the accompanying drawings, and the claims.

DESCRIPTION OF DRAWINGS

Like reference symbols in the various drawings indicate like elements.

DETAILED DESCRIPTION

Figure 1B:
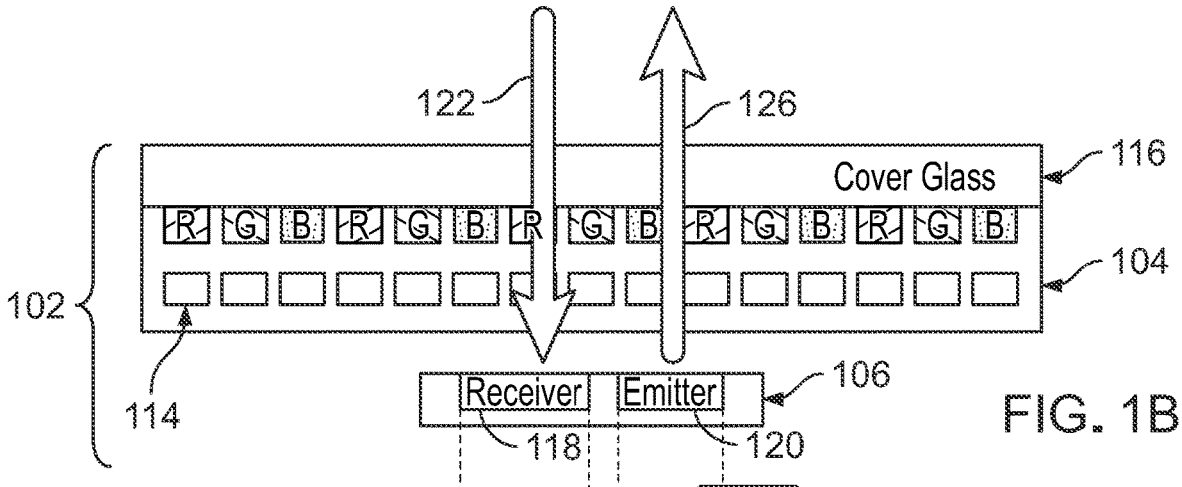
FIG. 1A and FIG. 1B are a plan view and a cross-sectional view, respectively, of an apparatus including a display panel and sensors electrically connected to and located below specific locations (also referred to as areas) of the screen of a computing device.
Figure 1A:
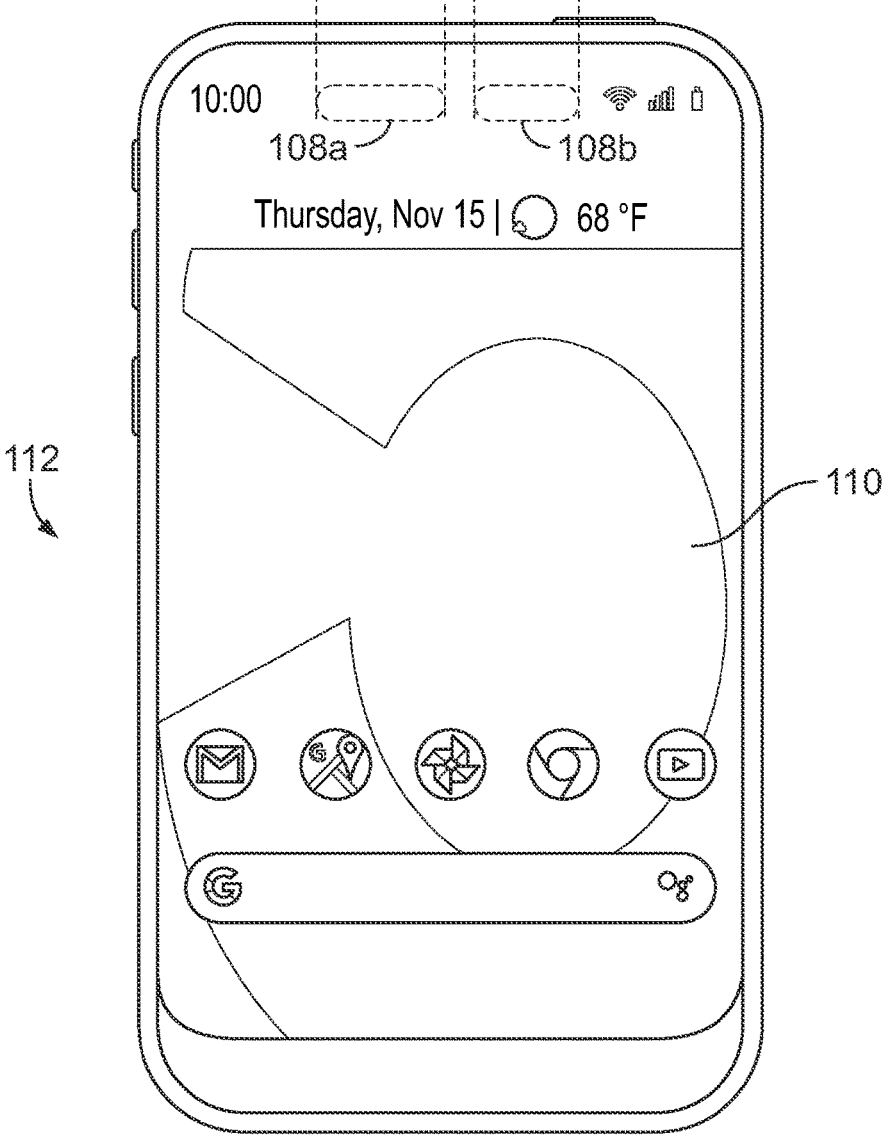

FIG. 1A and FIG. 1B are a plan view and a cross-sectional view, respectively, of an example apparatus 102 (e.g., a smartphone) including a display panel 104 and sensors 106 located below the display panel. Apparatus 102 is part of a computing device 112 (e.g., a smartphone) for which display panel 104 forms a screen 110. Screen 110 includes discrete areas 108*a* and 108*b* under which sensors 106 are located. As discussed below, operation of display 104 and sensors 106 can be electrically synchronized at specific areas 108*a* and 108*b*. Each of the locations 108*a* and 108*b* can also be referred to as "local" areas.

The display panel 104 includes pixels, each of which can include two or more sub-pixels—e.g., red sub-pixels, green sub-pixels, and blue sub-pixels. Each sub-pixel has a corresponding sub-pixel circuit 114, which controls emission from a respective organic light emitting diode (OLED) of the sub-pixel. The OLED for the sub-pixel circuit 114 for the red sub-pixel is shown as R, the OLED for the sub-pixel circuit 114 for the green sub-pixel is shown as G, and the OLED for the sub-pixel circuit 114 for the blue sub-pixel is shown as B. The OLED R is configured to emit red light, the OLED G is configured to emit green light, and the OLED B is configured to emit blue light. The OLEDs R, G and B are part of the corresponding sub-pixel circuits 114 (as clarified in FIGS. 3A-3C, 4, 5, 7 and 8), but are shown separate in FIG. 1B only for simplicity. The sub-pixel circuits 114 are a part of the display panel 104. The display panel 104 can further includes a cover glass 116 and/or other components (e.g., a polarizer and/or other optical or protective layers).

Some disadvantages associated with traditional sub-pixel circuits that are overcome using the modified sub-pixel circuits are explained below with respect to FIGS. 2 and 3A-3C, and aspects of the modified sub-pixel circuits are described in greater detail below by FIGS. 4-9.

Sensor 106 includes a receiver 118 and an emitter 120. During operation, emitter emits electromagnetic (EM) radiation 126 (e.g., infrared radiation) which travels through display panel 104 and into the ambient environment. Some of the emitted EM radiation is reflected back to the sensor, and is received by receiver 118 as a signal 122. Generally, the type of EM radiation emitted by sensor 106 depends on the type of sensor.

The display panel 104 can be driven with an active matrix addressing scheme, and can be referred to as an active matrix organic light emitting diode (AMOLED) panel. The active matrix display scheme can be advantageous over a passive matrix display scheme in a passive matrix organic light emitting diode (PMOLED) panel, as AMOLED panels can provide higher refresh rates than PMOLED panels, and consume significantly less power than PMOLED panels. A sub-pixel can also be denoted using the term subpixel.

Sensor 106 can include one or more of: at least one facial detection sensor, at least one proximity sensor, an image sensor such as a front facing camera or at least one sensor configured to sense machine readable representation of data such as barcode and/or quick response (QR) code, any other one or more sensors that have an emitter, and/or any combination thereof. In some implementations, the apparatus 102 can, in addition or as an alternate to the sensor 106, include other sensors such as the at least one global positioning system (GPS), at least one ambient light sensor, at least one fingerprint sensor, at least one heart rate sensor, at least one thermometer, at least one air humidity sensor, at least one radiation level sensor, and any other appropriate sensor.

The local areas 108*a* and 108*b* are shown at certain locations (e.g., areas) on the screen 110. In alternate implementations, the sensors 106 and corresponding local areas 108*a* and 108*b* can be located at any other one or more places on the screen 110 where sensor 106 is located. In some implementations, the local areas 108*a* and 108*b* can occupy any less amount or any more amount of screen space than that shown in FIG. 1A.

In general, the computing device 112 can be a mobile device, such as a phone, a tablet computer, a phablet computer, a laptop computer, a wearable device such as a smartwatch, a digital camera, any other one or more mobile device, and/or the like. In alternate implementations, the computing device 112 can be any other computing device such as a desktop computer, a kiosk computer, a television, and/or any other one or more computing devices.

Figure 2:
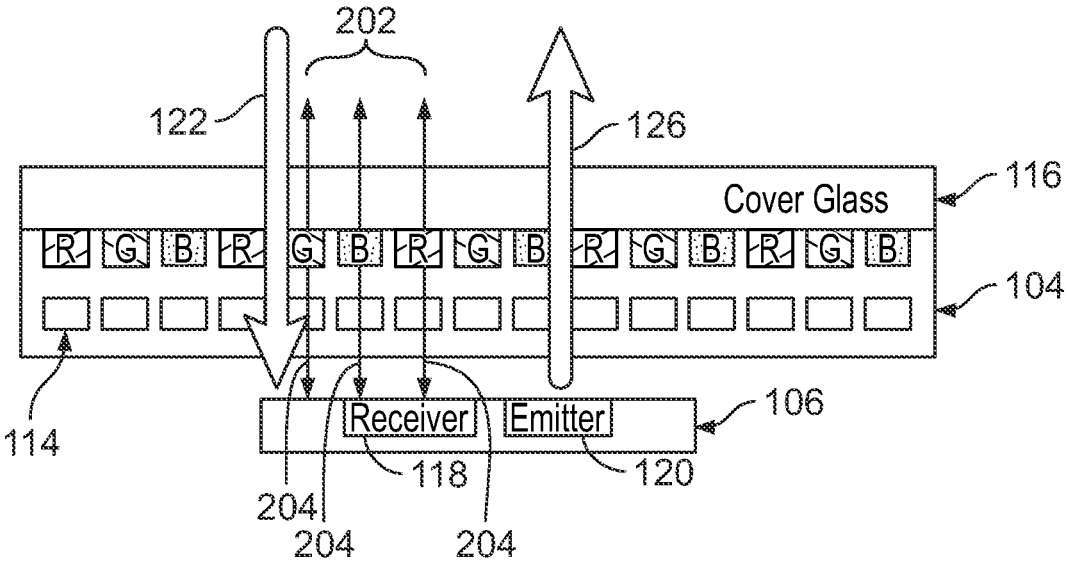
FIG. 2 is a cross-sectional view of an apparatus, showing various parts of a signal emitted from the sensor emitter, and a portion of such signal (e.g., the off-state signal) being leaked back into the sensor receiver.

FIG. 2 illustrates operation of sensor 106 and display panel 104 in a manner lacking synchronization between them. Specifically, sub-pixels proximate to receiver 118 emit light 202 which contributes to an image being presented by the display. Some of this light 204 is leaked backward by the pixels towards receiver 118. Such light 204 can be noise to the sensor 106. Simultaneously, the sensor emitter 120 emits EM radiation 126 which is to return to the sensor receiver 118 through the display panel depicted by signal 122. The EM radiation from the sensor emitter 120 can cause the unintended pixel operation by increasing the transistor off-leakage current in the pixel circuit when the EM radiation 126 passes through the display panel from the backside of the panel, and could affect the image quality on the screen.

However, such effects can be mitigated by modifying the sub-pixel circuits for those pixels affected. For example, the sub-pixel circuits 114 in the apparatus 102 can include modifications to conventional sub-pixel circuits 206, as described by FIGS. 4-9, and such modifications minimize and/or eliminate undesirable impact on image quality as caused by the off-state leakage current of transistor switches in the sub-pixel circuit 114. Such modifications in the sub-pixel circuits 114 can minimize or eliminate adverse effects on image quality by (1) locally turning off light emission from the sub-pixels for as short a time as possible in the area where the sensors 106 are located underneath, while (2) synchronizing the light emission from the sub-pixels with operation of the sensor 106.

Figure 3A:
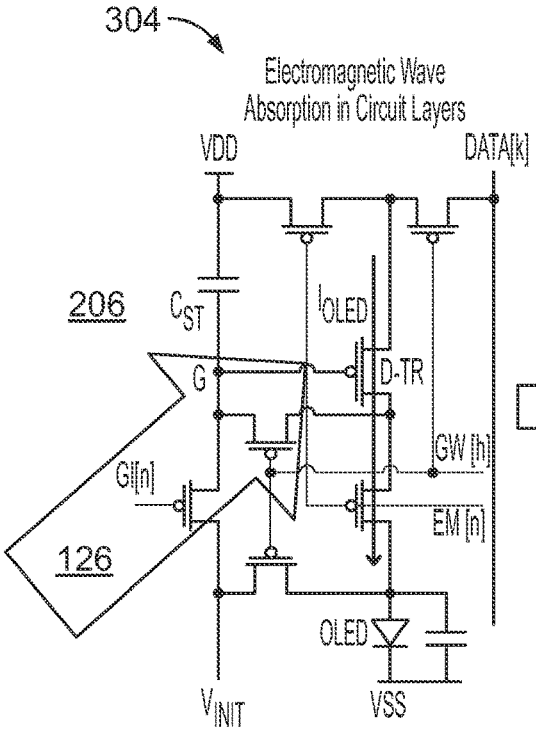
FIGS. 3A-3C are circuit diagrams illustrating a process of undesirable brightening of a sub-pixel in an apparatus in response to electromagnetic absorption in circuit layers.
Figure 3B:
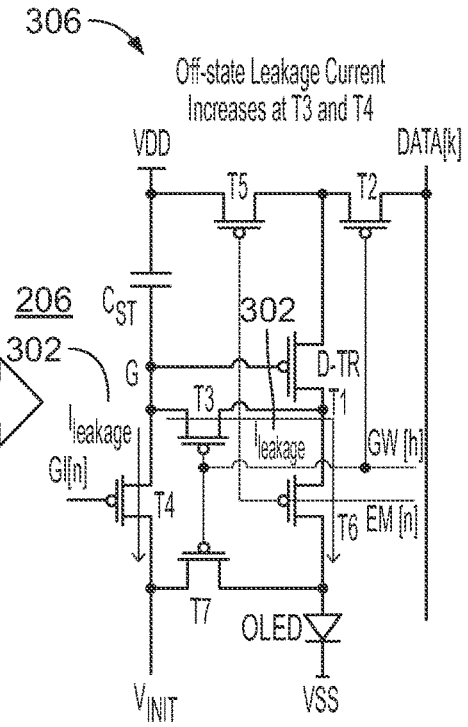

FIGS. 3A-3B illustrate the process of undesirable brightening of a sub-pixel in during conventional operation in response to EM radiation absorption in pixel circuit layers. A conventional apparatus has a traditional sub-pixel circuits 206, such that each traditional sub-pixel circuit 206 can have a sub-pixel circuit structure that specifically has seven transistors and one capacitor (i.e., the seven transistors and one capacitor sub-pixel circuit structure, which can also be simply referred to as the 7T1C sub-pixel circuit structure).

The traditional sub-pixel circuit 206 can receive, at 304, EM radiation 126 from an emitter of the sensor under the conventional display screen. In response to the EM radiation 126, the sub-pixel circuit 206 can generate an off-state signal (e.g., leakage signal, which can be leakage current) 302. The leakage signal/current can, at 306, cause the electrical charge transfer through the transistors T3 and T4, which are both configured to be switches within the traditional sub-pixel circuit 206. Because of the leakage current through the transistors T3 and T4, the voltage at the gate electrode G decreases at 308, which in turn causes an increase, also at 308, in $I_{OLED}$, which is the signal or current in the OLED of the traditional sub-pixel circuit 206. The increase in $I_{OLED}$ causes the sub-pixel associated with the traditional sub-pixel circuit 206 to become abnormally brighter than usual. This abnormally brighter sub-pixels can cause undesirable glowing of the sub-pixels while the local area is supposed to display black images, which is the case when the sensors under the local area are in operation.

Figure 3C:
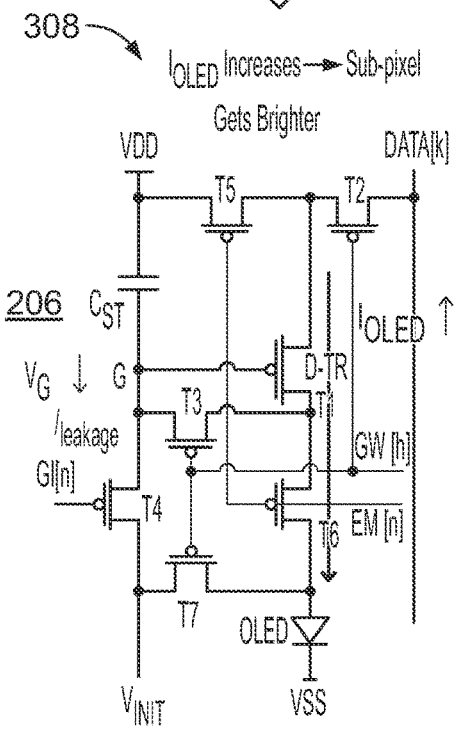
Figure 4:
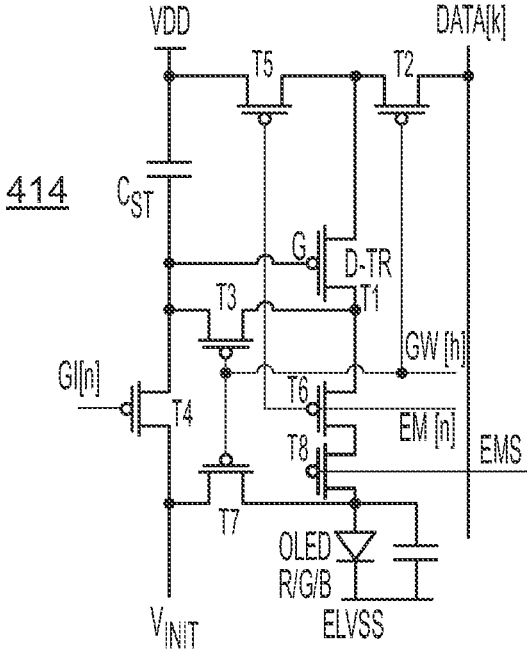
FIG. 4 is a circuit diagram of a sub-pixel circuit including a first modification to the sub-pixel circuit of FIGS. 3A-3C for areas above the locations of the sensors (i.e., for "local" areas).

FIG. 4 illustrates a first portion of the sub-pixel circuit 414 showing a first modification to the conventional sub-pixel circuit 206 of FIGS. 3A-3C for areas above the locations of the sensors 106 (i.e., for "local" areas 108*a* and 108*b*). This first modification is addition of an emission control switch, which allows emission for the corresponding sub-pixel to be switched off synchronously with the operation of the sensor. In this case, the emission control switch is an additional transistor, T8 to the conventional circuit to provide an emission control signal, EMS, for the areas of the display panel 104 below which the sensor 106 is located.

Although the transistor T8 is shown as being implemented between transistor T6 and the color OLED layer 110, in alternate implementations the transistor T8 can be connected anywhere between the voltage point VDD and the color OLED layer 110. For example, the transistor T8 can be connected between the voltage point VDD and the transistor T5, the transistor T5 and the transistor T1, the transistor T1 and the transistor T6, and the transistor T6 and the anode of the color OLED layer 110.

In some implementations, a single emission control signal EMS can control all the local areas 108*a* and 108*b*, as described below with reference to FIG. 6. In alternate implementations, a separate emission control signal EMS can be used for each corresponding local area 108*a*/108*b* such that sub-pixels for each local area 108*a*/108*b* can be controlled independent of other local areas 108*b*/108*a*.

Figure 5:
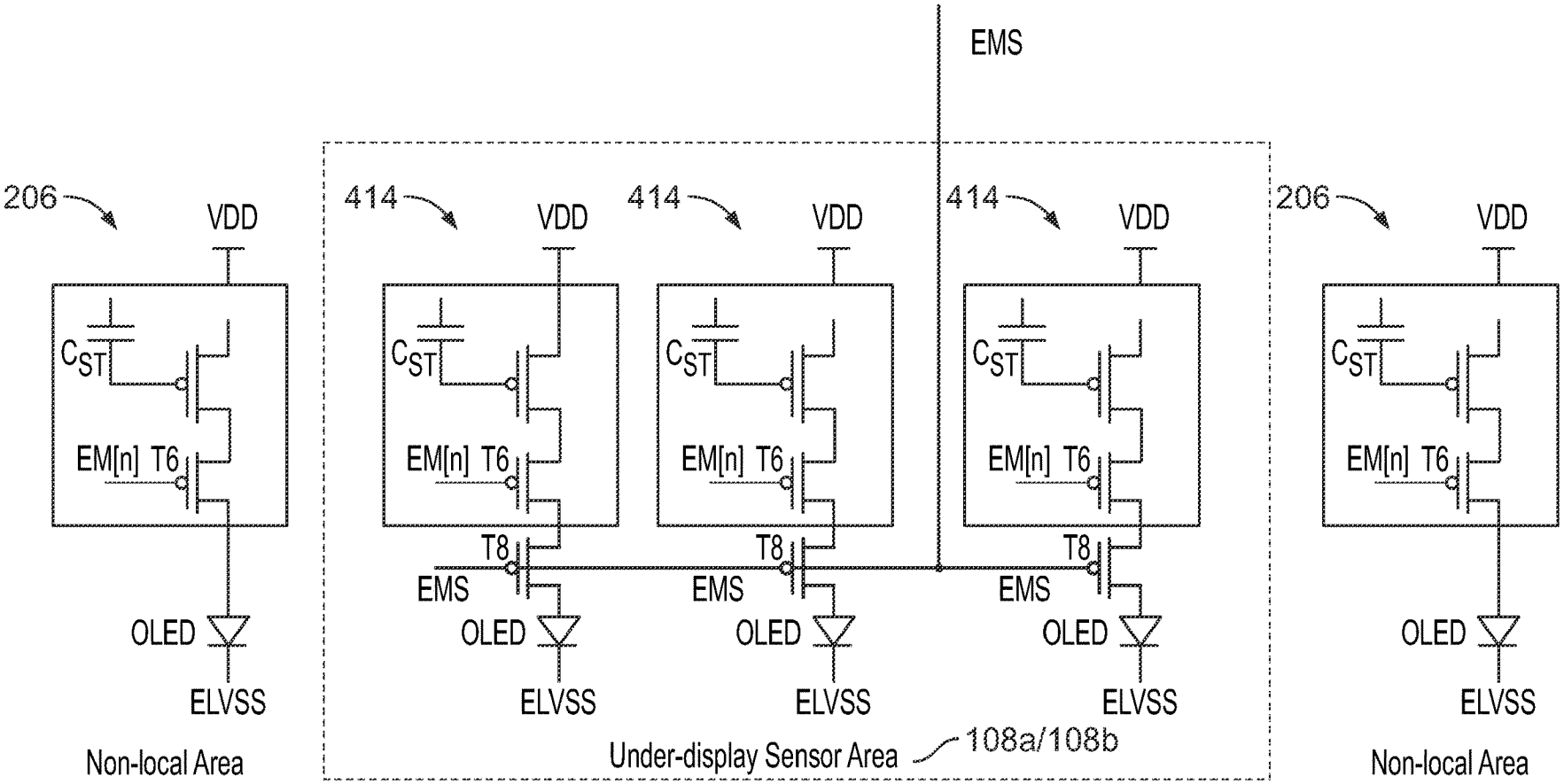
FIG. 5 is a circuit diagram showing sub-pixel circuits within each "local" area of the display panel being controlled by additional pixel emission control signal, EMS, such that light emission from local sub-pixel circuits can be turned on/off together being synchronized with the operation of a sensor underneath the display, while other sub-pixel circuits are controlled only by a conventional emission control signal.

FIG. 5 illustrates sub-pixel circuits 414 within each local area 108*a*/108*b* of the display panel 104. Outside of local areas 108*a*/108*b* are traditional sub-pixel circuits 206. Every circuit 414 can be controlled by a single emission control signal EMS such that each such sub-pixel circuit 414 can be turned on/off together (which is to turn-off all sub-pixels in the local area 108*a*/108*b* at the same time being synchronized with the operation of the sensors underneath. For example, the EMS can stop emission from the corresponding sub-pixels for short time periods (e.g., 10 milliseconds or less, 5 milliseconds or less, 2 milliseconds or less) while the sensor is emitting and/or detecting EM radiation.

Figure 6:
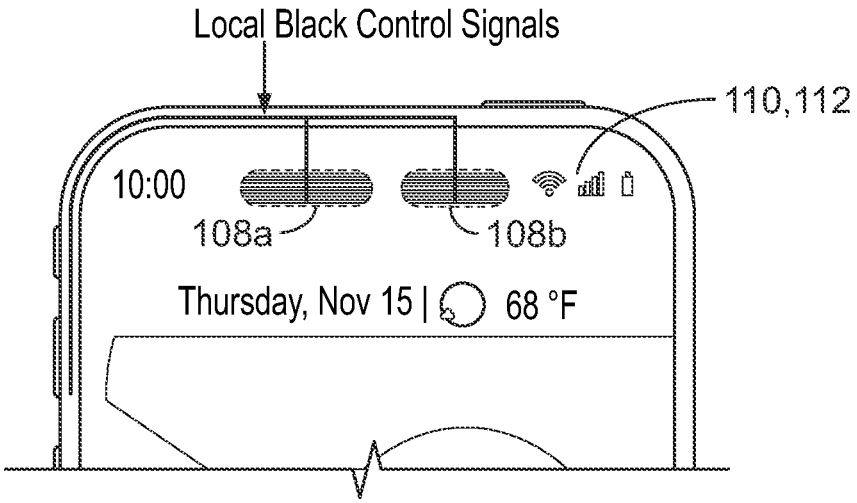
FIG. 6 illustrates an additional pixel emission control signal (EMS) controlling all sub-pixel circuits within two local areas of a display panel.

This arrangement is also shown in FIG. 6, which is described below. Turning off the sub-pixels using the EMS eliminates the creation of increased $I_{OLED}$ (which was the problem with traditional sub-pixel circuits 206, as shown in FIGS. 3A-3C), which in turn obviates the problem in conventional sub-pixel circuits 206 regarding abnormal brightness of the sub-pixels. Note that the non-local areas (i.e., areas of the display panel that do not have sensors 106 below them) have sub-pixel circuits 206 rather than sub-pixel circuits 414.

FIG. 6 illustrates a single electromagnetic control signal (EMS) controlling all sub-pixel circuits 414 within the two local areas of a display panel 104, as described using circuits in FIG. 5. Here, a single emission control signal EMS can control sub-pixels in all the local areas, as described below by FIG. 6. In alternate implementations, a separate emission control signal EMS can be used for each corresponding local area such that sub-pixels for each local area can be controlled independent of other local areas. The single emission control signal EMS can be generated and supplied from the display driver IC or a timing controller circuit in the display driving system, and the trace line/lines for the EMS signal can be placed on the panel edge areas reaching the local areas 108*a* 108*b*.

Figure 7:
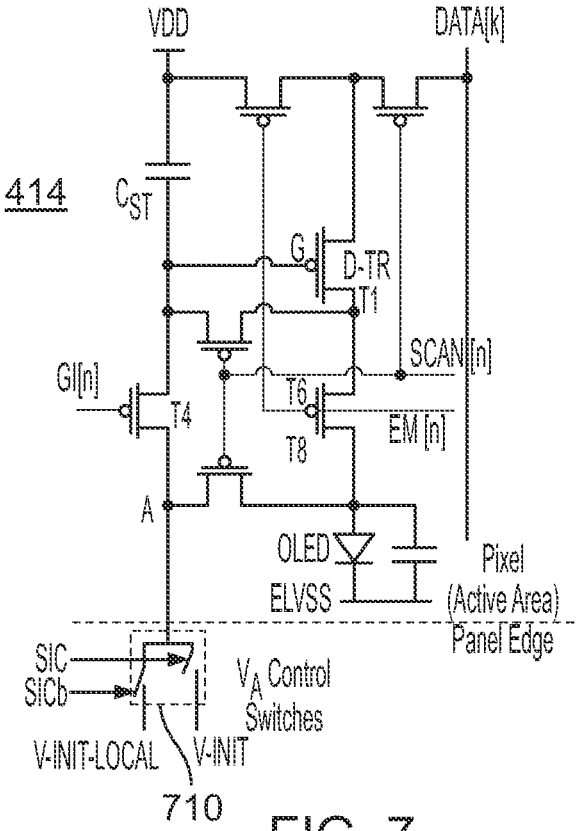
FIG. 7 is a circuit diagram of a sub-pixel circuit including a second modification to the sub-pixel circuit of FIGS. 3A-3C.

FIG. 7 illustrates a second portion of the sub-pixel circuit 414 showing another modification to the traditional sub-pixel circuit 206 of FIGS. 3A-3C. This modification is to place locally independent voltage supplies for the initialization voltage $V_{INIT_LOCAL}$ for sub-pixels in the local areas 108*a* and 108*b* and another initiation voltage $V_{INIT}$ for all other sub-pixels (i.e., sub-pixels in the non-local areas of the display panel 104). During the pixel circuit 414 operation, the node A voltage, $V_A$, can be two or more different levels, such as $V_{INIT_LOCAL}$ and $V_{INIT}$ depending on the operation of sensors underneath, which means this voltage level change is synchronized to the sensor operation. When the sensors (receivers or emitters) are in operation, $V_A$ needs to be $V_{INIT_LOCAL}$, which is preferably higher voltage than $V_{INIT}$, such that the pixel circuits 414 do not generate $I_{OLED}$ to the corresponding OLED device in the pixel, and the pixel area becomes black. A switch block 710 that select one of multiple voltage levels for $V_A$, such as $V_{INIT_LOCAL}$ and $V_{INIT}$, can be located in the display driver IC, separate discrete power management IC, or panel border region. The application of higher voltage $V_{INIT_LOCAL}$ to the sub-pixel circuit 414 results in the transistor switch T1 to be rendered in an off state, which can prevent current from going to the color OLED layer 110, which in turn darkens the sub-pixels in the local areas 108*a* and 108*b*.

Although the second portion of the sub-pixel circuit 414 is shown in this drawing as being independent of the first portion shown in FIGS. 4-6, in an alternate circuit both the first portion and the second portion of the sub-pixel circuit 414 can co-exist.

Figure 8:
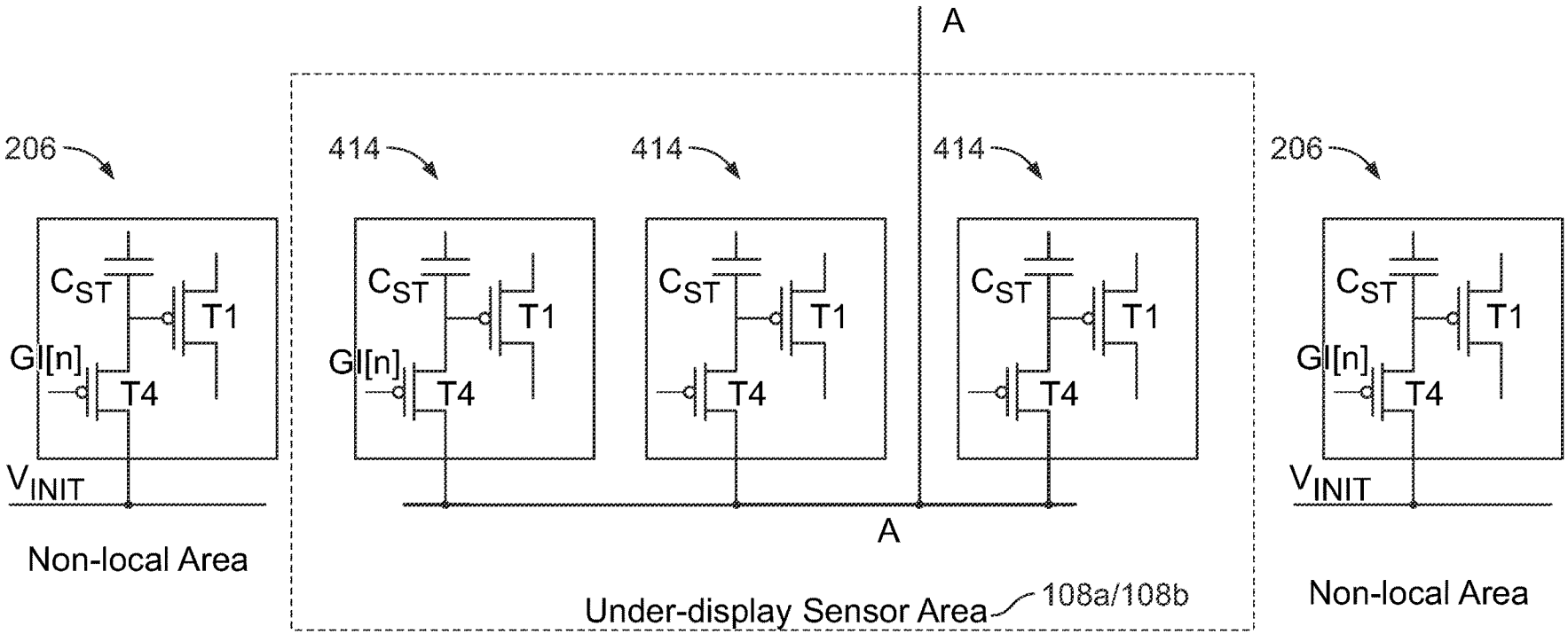
FIG. 8 is a circuit diagram showing a local pixel emission control for the voltage $V_A$ across node A in each sub-pixel circuit within a local area.

FIG. 8 illustrates a single control for the voltage $V_A$ across node A in each sub-pixel circuit 414 within a local area 108*a* and/or 108*b*. This can synchronize the impact of the functioning of the control switch.

Figure 9:
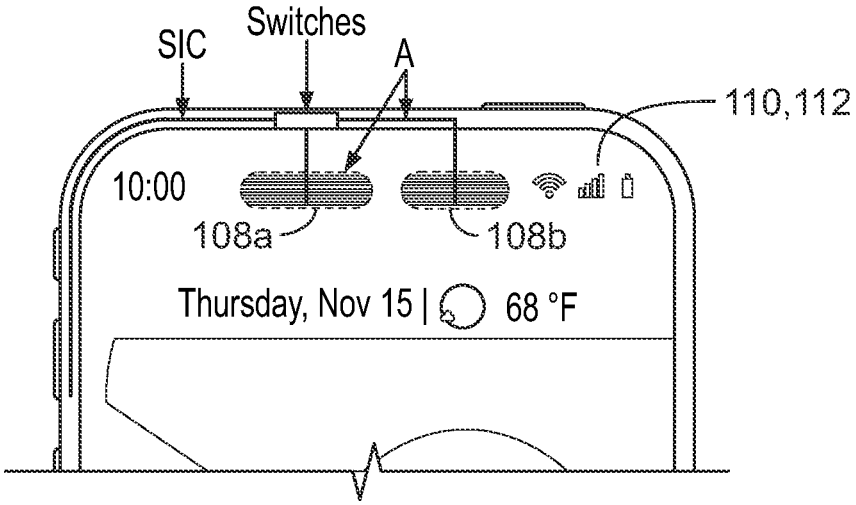
FIG. 9 illustrates a configuration of a switching block at a display panel border region, as described using circuits in FIGS. 7 and 8.

FIG. 9 illustrates a display panel configuration when the $V_A$ control switch block is located on the top side of the display border. In this configuration, the switch control signals, SIC and SICb in FIG. 7 are routed in the display panel being generated from the display driver IC or a separate timing controller circuit, and are synchronized with the sensor 106 operation. The voltage level chosen by the switch block is supplied to the node A of each sub-pixel circuit in the local areas 108*a* and/or 108*b*, as described using circuits in FIGS. 7 and 8.

Figure 10:
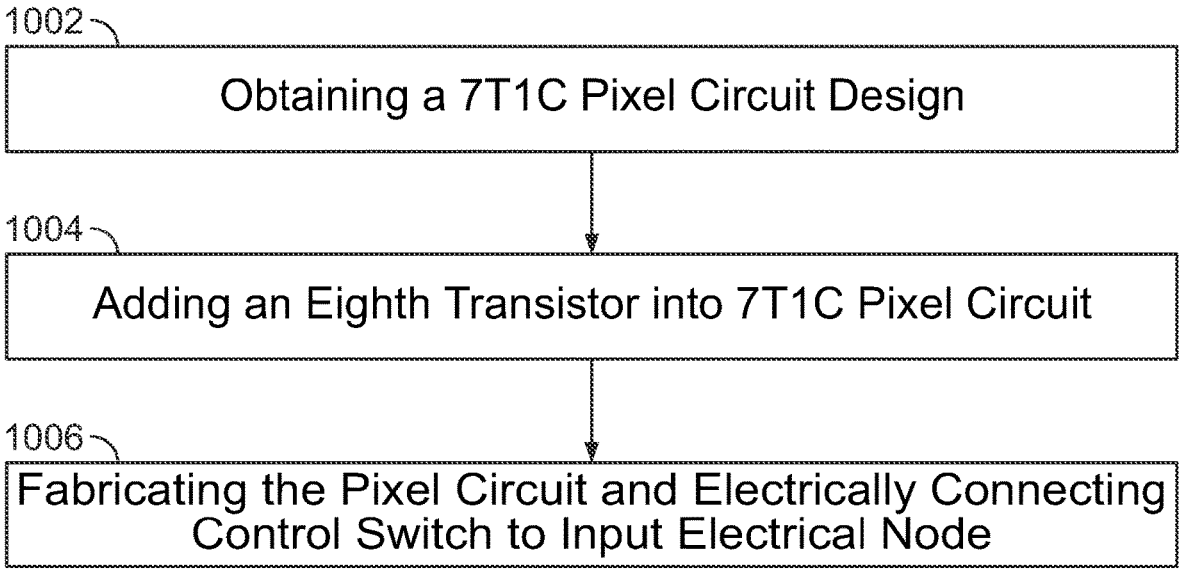
FIG. 10 is a flow chart showing a method of modifying a conventional 7T1C sub-pixel circuit to attain the modifications of FIGS. 2, 4, 5, 7 and 8 so as to eliminate leakage current.

FIG. 10 illustrates a method of modifying a conventional 7T1C sub-pixel circuit 206 to attain the modifications of FIGS. 2, 4, 5, 7 and 8 so as to eliminate leakage current. The 7T1C sub-pixel circuit 206 can be obtained at 1002. The 7T1C sub-pixel circuit 206 can include seven transistors T1-T8 and one capacitor CST. The 7T1C sub-pixel circuit 206 can include an input electrical node "A" configured to be powered with a first initialization voltage $V_{INIT}$. The 7T1C sub-pixel circuit 206 can have an OLED 110 of a plurality of OLEDs 110. The 7T1C sub-pixel circuit 206 can be configured to control a drive current to be passed through the OLED 110 to control light emission from the OLED 110. The plurality of OLEDs 110 can be combined in an active matrix to form an active matrix organic light emitting diode (AMOLED) panel. The 7T1C sub-pixel circuit 206 can be above a sensor 106.

An eighth transistor T8 can be wired, at 1004, into the 7T1C sub-pixel circuit 206. The eighth transistor T8 can be configured to operate as a switch controlling the drive current.

A control switch (e.g., $V_A$ control switch, as shown in FIG. 7) can be electrically connected, at 1006, to the input electrical node. The control switch (e.g., the $V_A$ control switch) can provide the 7T1C circuit with a selection between the first initialization voltage $V_{INIT}$ and a second initialization voltage $V_{INIT_LOCAL}$ to initialize electrodes in the 7T1C circuit 206. The second initialization voltage $V_{INIT_LOCAL}$ can be higher than the first initialization voltage $V_{INIT}$. The control switch (e.g., $V_A$ control switch) can be electrically connected to a control integrated circuit (now shown) that can cause the control switch (e.g., the $V_A$ control switch) to select the second initialization voltage $V_{INIT_LOCAL}$ when the sensor 106 emits electromagnetic waves.

The control integrated circuit can be at least one of a display drive integrated circuit, a timing controller block, and a sensor system. The selection of the second initialization voltage $V_{INIT_LOCAL}$ can render a transistor T1 of the 7T1C circuit in an off-state that prevents flow of current from the transistor T1 to the OLED 110. The prevention of the flow of current to the OLED 110 can prevent undesired illumination of the pixels in the region where sensor emitters are located underneath areas 108*a*/108*b*.

Various implementations of the subject matter described herein can be implemented in digital electronic circuitry, integrated circuitry, specially designed application specific integrated circuits (ASICs), computer hardware, firmware, software, and/or combinations thereof. These various implementations can be implemented in one or more computer programs. These computer programs can be executable and/or interpreted on a programmable system. The programmable system can include at least one programmable processor, which can have a special purpose or a general purpose. The at least one programmable processor can be coupled to a storage system, at least one input device, and at least one output device. The at least one programmable processor can receive data and instructions from, and can transmit data and instructions to, the storage system, the at least one input device, and the at least one output device.

These computer programs (also known as programs, software, software applications or code) can include machine instructions for a programmable processor, and can be implemented in a high-level procedural and/or object-oriented programming language, and/or in assembly/machine language. As can be used herein, the term "machine-readable medium" can refer to any computer program product, apparatus and/or device (for example, magnetic discs, optical disks, memory, programmable logic devices (PLDs)) used to provide machine instructions and/or data to a programmable processor, including a machine-readable medium that can receive machine instructions as a machine-readable signal. The term "machine-readable signal" can refer to any signal used to provide machine instructions and/or data to a programmable processor.

To provide for interaction with a user, the screen 110 can display data to a user. The sensors 106 can receive data from the one or more users and/or the ambient environment. The computing device 112 can thus operate based on user or other feedback, which can include sensory feedback, such as visual feedback, auditory feedback, tactile feedback, and any other feedback. To provide for interaction with the user, other devices can also be provided, such as a keyboard, a mouse, a trackball, a joystick, and/or any other device. The input from the user can be received in any form, such as acoustic input, speech input, tactile input, or any other input.

Although various implementations have been described above in detail, other modifications can be possible. For example, the logic flows described herein may not require the particular sequential order described to achieve desirable results. Other implementations are within the scope of the following claims.

What is claimed is:

1. An apparatus, comprising:

a display panel comprising an array of pixels configured to direct light through a front side of the display panel, each pixel comprising one or more sub-pixels, each sub-pixel comprising an organic light emitting diode (OLED) and an integrated circuit for controlling an electrical current to the OLED, the array of pixels comprising a first area and a second area different from the first area;

a sensor arranged at a back side of the display panel, the back side being opposite the front side, the sensor comprising an emitter configured to emit electromagnetic (EM) radiation transmitted through the first area of the display panel; and a control device connected to the integrated circuit of sub-pixels of the array of pixels within the first area of the array of pixels, wherein the integrated circuit of one or more sub-pixels of the array of pixels outside the first area of the display panel comprises a first integrated circuit arrangement comprising seven transistors and one capacitor controlling the electrical current to the OLED, and the integrated circuit of one or more sub-pixels of the array of pixels only within the first area of the display panel comprises an additional transistor in addition to the first integrated circuit arrangement, the additional transistor being configured to operate as a control switch controlling emission of light from the respective sub-pixel, wherein one or more of the seven transistors of the first integrated circuit arrangement for at least one sub-pixel in the first area receives EM radiation from the sensor during operation of the sensor, wherein a gate of the control switch is connected to the control device programmed to synchronize emission of light from the at least one sub-pixel in the first area with emission of EM radiation from the sensor so that the at least one sub-pixel is turned off when the sensor emits EM radiation, the control device being programmed to provide the integrated circuit of the at least one sub-pixel in the first area with a selection between a first initialization voltage and a second initialization voltage to initialize the integrated circuit of the at least one sub-pixel in the first area, the second initialization voltage being higher than the first initialization voltage, the control device being electrically connected to a control integrated circuit that causes the control switch to select the second initialization voltage when the sensor emits electromagnetic waves.

2. The apparatus of claim 1, wherein the transistor is connected between a power source that supplies current to the sub-pixel circuit of the one or more sub-pixels of the array of pixels within the first area and the OLED of the corresponding sub-pixel.

3. The apparatus of claim 1, wherein the synchronizing emission of light from the sub-pixel with emission of EM radiation from the sensor reduces undesirable light emission from the sub-pixel due to absorption of EM radiation by the integrated circuit of the sub-pixel.

4. The apparatus of claim 3, wherein the synchronized emission prevents abnormal brightening of at least one sub-pixel of the array of pixels within the particular area.

5. The apparatus of claim 3, wherein the control device is configured to synchronize emission of light from multiple sub-pixels in the first area of the display panel with emission of EM radiation from the sensor to reduce undesirable light emission from the sub-pixel due to absorption of EM radiation by the integrated circuits of the multiple sub-pixels.

6. A mobile device comprising the apparatus of claim 1.

7. An apparatus comprising:

at least one sensor comprising an emitter configured to emit electromagnetic radiation; and a display panel comprising an array of pixels located in a first area away from at least one sensor and a second area above the at least one sensor, each pixel of the array of pixels comprising two or more sub-pixels, one or more sub-pixels of the array of pixels within the first area comprising a first sub-pixel circuit electrically initialized by a first initialization voltage during operation, one or more sub-pixels of the array of pixels in the second area comprising a second sub-pixel circuit electrically initialized by a second initialization voltage during operation, the second sub-pixel circuit being coupled to a control switch used to select the second initialization voltage during operation, the second initialization voltage being selected from options comprising the first initialization voltage and another voltage that is higher than the first initialization voltage, the control switch being controlled to select the second initialization voltage as the other voltage when the emitter emits the electromagnetic radiation, wherein only sub-pixels of the array in the second area are coupled to the control switch.

8. The apparatus of claim 7, wherein the control switch is controlled by signals generated from one of a display driver IC, a timing controller IC, or a sensor system.

9. The apparatus of claim 7, wherein the second area comprises a plurality of sub-pixel circuits including the second sub-pixel circuit, wherein during operation an initialization voltage of each sub-pixel circuit of the plurality of sub-pixel circuits is synchronized with other sub-pixel circuits of the plurality of sub-pixel circuits.

10. The apparatus of claim 7, wherein the selection of the second initialization voltage is configured to render a transistor of the second sub-pixel circuit in an off state, the off state of the transistor preventing the second sub-pixel from emitting light.

11. A mobile device comprising the apparatus of claim 7.

12. A method of modifying a sub-pixel circuit of an active matrix organic light emitting diode (AMOLED) display comprising an array of pixels each comprising one or more sub-pixels, the array of pixels comprising a first area and a second area different from the first area, the method comprising:

for sub-pixels only in the first area of the array of pixels, obtaining a sub-pixel circuit, the sub-pixel circuit comprising seven transistors and one capacitor, the sub-pixel circuit comprising an input electrical node configured to be initialized with a first initialization voltage, the sub-pixel circuit being coupled to an organic light emitting diode (OLED) of a plurality of OLEDs of the AMOLED display, the sub-pixel circuit being configured to control a drive current to be passed through the OLED to control light emission from the OLED;

wiring an additional transistor into the sub-pixel circuit obtained for sub-pixels only in the first area, the additional transistor configured to operate as a switch controlling a drive current in addition to already existing emission control switches in the sub-pixel circuit; and electrically connecting a control device to the input electrical node, the control device providing the sub-pixel circuit with a selection between the first initialization voltage and a second initialization voltage to initialize the sub-pixel circuit, the second initialization voltage being higher than the first initialization voltage, the control device electrically connected to a control integrated circuit that causes the control device to select the second initialization voltage when a sensor associated with the AMOLED display emits electromagnetic waves.

13. The method of claim 12, wherein the control integrated circuit is at least one of a display driver IC, a timing controller block, and a sensor system.

14. The method of claim 12, wherein the selection of the second initialization voltage results renders a transistor of the sub-pixel circuit in an off-state that prevents light emission from the OLED.

15. The method of claim 12, further comprising assembling a mobile device comprising the AMOLED display and a sensor arranged behind the display and arranged to emit electromagnetic radiation through the display at the first area of the array of pixels.

* * * * *